United States Patent [19]

Meeks

[11] 4,343,501

[45] Aug. 10, 1982

[54] DOOR HANDLE ASSEMBLY

[75] Inventor: Alan M. G. Meeks, Basingstoke, England

[73] Assignee: ITW Limited, Windsor, England

[21] Appl. No.: 126,777

[22] Filed: Mar. 3, 1980

[30] Foreign Application Priority Data

Mar. 1, 1979 [GB] United Kingdom ..... 7907231

[51] Int. Cl.[3] ..... E05C 3/00; E05C 5/00; E05C 19/14

[52] U.S. Cl. ..... 292/336.3; 292/113; 292/247; 292/DIG. 30; 292/DIG. 31; 292/DIG. 53

[58] Field of Search ..... 292/336.3, 113, 247, 292/DIG. 30, DIG. 31, DIG. 53

[56] References Cited

U.S. PATENT DOCUMENTS 3,795,416 3/1974 Hehl ..... 292/336.3
4,038,718 8/1977 Reithac ..... 292/336.3

FOREIGN PATENT DOCUMENTS 2824216 6/1979 Fed. Rep. of Germany ..... 292/337

*Primary Examiner*—Robert L. Wolfe
*Attorney, Agent, or Firm*—J. R. Halvorsen; T. W. Buckman

[57] ABSTRACT

There is described in the specification an adjustable mounting (1), described in detail in conjunction with a vehicle door handle assembly. The mounting includes a main part (5) and a foot (6), the foot being a planar component provided with snap-engaging means to secure it on one side of an apertured panel (37), the side of the foot remote from the panel being formed with a series of teeth (19). The main part of the mounting includes abutment surfaces (8,12) to engage the side of the panel remote from the foot in areas (40,41) adjacent to the aperture, the abutment surfaces being so positioned and configured as to allow sliding motion of the main part in one direction relative to the panel. The main part further includes a series of teeth (20) complementary to the teeth of the foot, the two complementary series of teeth interlocking when the abutment surfaces of the main part engage the panel to prevent relative motion between the main part and the foot.

A door handle assembly including the adjustable mounting is described, the assembly including an operating lever (2) pivotally attached to the main part (5) of the mounting, the operating lever including a finger plate (21) and a crank arm (22) the crank arm extending through an opening (15) in the main part of the mounting and through a slot (16) in the foot. To facilitate post-assembly adjustment of the mounting, the opening (15) and the slot (16) may each be formed with one of two series of opposing cutouts (34,35) which can be engaged by a tool (36), rotation of the tool urging the main part and the foot to move relatively one to the other.

11 Claims, 18 Drawing Figures

Fig. 3.
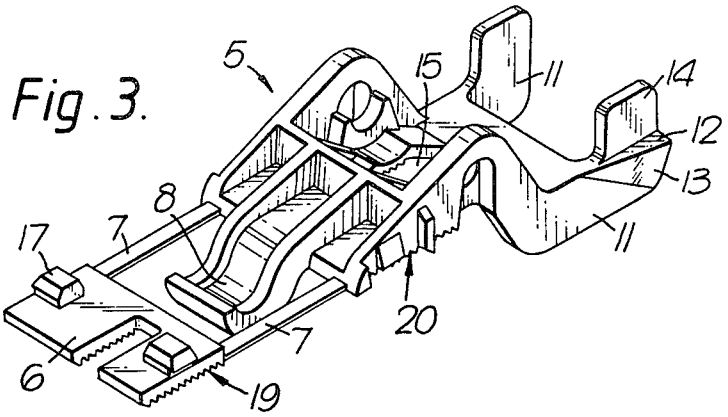
Fig. 4.
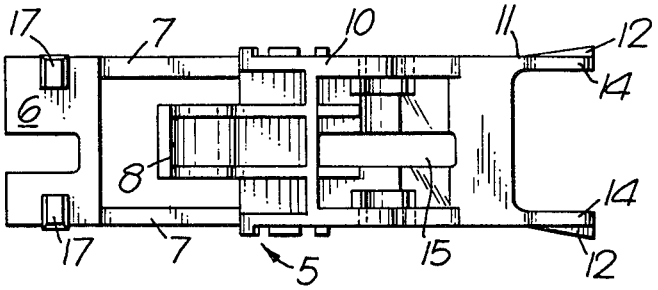
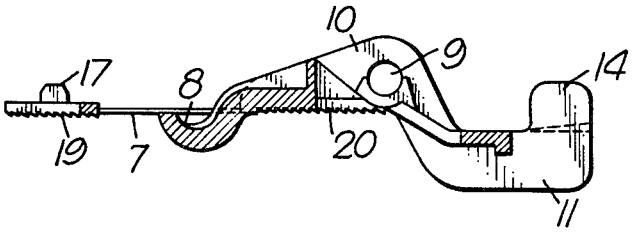
Fig. 5.

DOOR HANDLE ASSEMBLY

This invention relates to adjustable mounting and particularly concerns adjustable mounting assemblies for the interior door handles of automobiles.

In recent years, changing consumer tastes and safety regulations have lead to a move away from the more traditional type of handle, which has a cranked arm projecting from the door, to a type of handle which is substantially flush with the door and is operated by lifting a finger plate out of the plane of the door.

This later type of handle is ideally suited to operate a pull rod mechanism connected to the door lock, but several drawbacks have been encountered with present designs.

These disadvantages include a certain difficulty in eliminating play from the operating linkage, often involving adjustable couplings of various sorts, and problems of mounting the handle assembly to the door panel.

The adjustable mounting assembly of the present invention is not only simply and quickly mounted securely to a door panel, but it also provides a means of adjusting the position of the door handle in a limited range to take up play in the operating linkage.

According to the present invention, as adjustable mounting for assembly to a panel comprises a main part and a foot, the foot being a substantially planar component and having on one face means to snap-engage in an aperture in the panel in order to secure the foot on one side of the panel and on its other face a series of teeth, and the main part incuding abutment surfaces to engage the side of the panel remote from the foot, the abutment surfaces being so positioned and configured as to allow sliding motion of the main part in one direction relative to the panel, and the main part further including a series of teeth complementary to those of the foot and situated between the abutment surfaces so that when the abutment surfaces engage the panel the teeth of the main part engage those of the foot to resist relative motion between the main part and the foot in one direction.

The mounting of the present invention has proved to be particularly effective when used in a door handle assembly which comprises a mounting and an operating lever attached thereto for pivotal motion between a first, rest, position and a second position, in which second position a linking rod connected to the operating lever is moved to activate a door catch mechanism, the mounting comprising a main part and a foot, the foot being a substantially planar component having on one face means to snap-engage an aperture in a panel in order to secure the foot to one side thereof, and on its other face a series of ratchet teeth, and the main part including abutment surfaces to engage the side of the panel remote from the foot and, between the abutment surfaces, a series of transversely extending ratchet teeth to co-operate with those of the foot and so situtated that when the abutment surfaces of the main part engage the panel, the ratchet teeth of the main part engage those of the foot to resist relative motion between the main part of the mounting and the foot in one direction.

An alternative handle assembly utilising a mounting according to the present invention has the operating lever mounted to the baseplate for pivotal motion between three distinct positions, the central position being a rest position and the other two positions being operative either to cause a linking rod to be in one instance pulled, and in the other pushed.

Preferably, in both types of handle assembly a resilient biasing means is included to urge the operating lever towards its rest position. This is achieved in the preferred embodiments by arranging a spring to bear on the baseplate and on the operating lever to produce a restoring moment when the operating lever is rotated. A coiled torsion spring having two tangentially extending arms may be used, one arm bearing on the baseplate and one arm bearing on the operating lever when the operating lever is moved from its rest position.

Preferably, the operating lever includes a crank arm extending through an opening the baseplate, so that the linking rod is situated on the side of the panel remote from the bulk of the handle assembly.

Two door handle assemblies incorporating the mounting of the present invention will now be particularly described with reference to the accompanying drawings, in which:

FIG. 3 shows a perspective view of a component of the assembly of FIG. 2 in its as-moulded configuration;

FIG. 4 is a plan view of the component of FIG. 3;

FIG. 5 is a central longitudinal section of the component of FIGS. 3 and 4;

Figure 1:
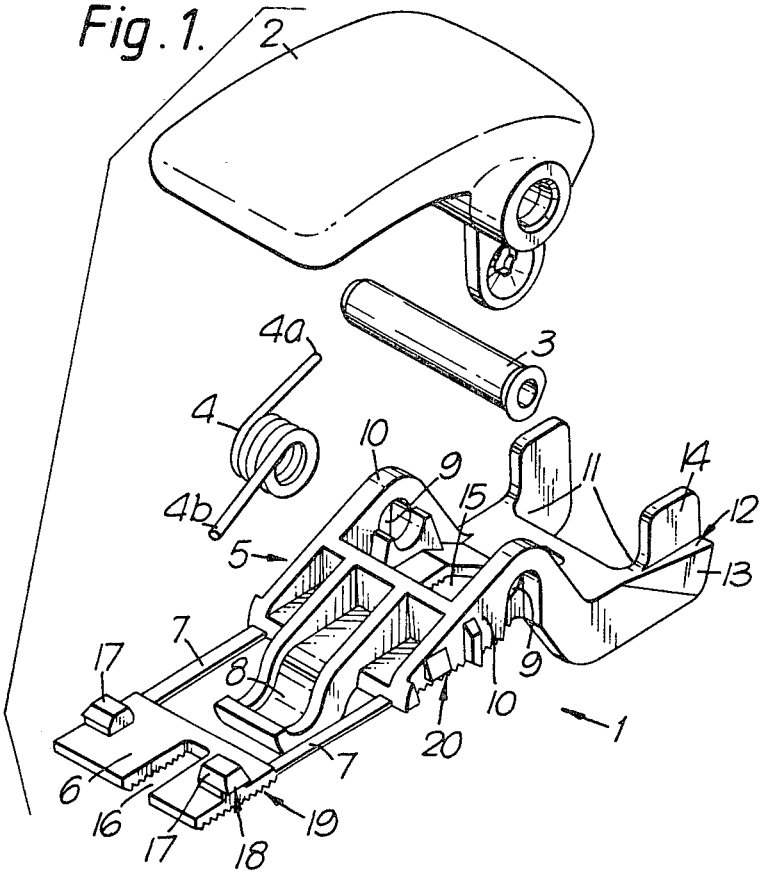
FIG. 1 shows an exploded perspective view of a first door handle assembly.

Referring now to FIGS. 1 to 10, there is shown a door handle assembly including a mounting 1, an operating lever 2, a spindle 3 and a torsion spring 4.

The mounting 1 comprises a main part 5 and a foot 6, preferably moulded integrally and joined by flexible straps 7, as shown.

The main part of the mounting includes at one end a hook 8 to engage the panel to which the mounting is assembled. Two aligned apertures 9 are provided in lugs 10 raised from the mounting, the apertures being engaged, by use, by the spindle 3. Between the lugs 10 is an opening 15, the purpose of which is set forth below. At the end of the mounting remote from the hook are two resilient arms extending away from the hook, the arms 11 being formed with abutment surfaces 12, ramp surfaces 13, and finger grips 14.

The foot 6 is planar rectangular element having an openended slot 16 extending from one of the longer sides perpendicularly towards the other. The top surface of the foot, as seen in FIG. 1, is formed with two lugs 17 each positioned adjacent the midpoint of one of the shorter sides and each provided with an abutment surfaces 18 projecting beyond the foot and spaced from the upper surface thereof. The undersurface of the foot is formed with a series of ratchet teeth 19 extending in planes perpendicular to the direction of the slot 16.

The underside of the main part 5 of the mounting is formed with a series of ratchet teeth 20 which are so configured as to be capable of intimate engagement with the ratchet teeth 19 of the foot, for purposes to be set forth below.

Figure 7:
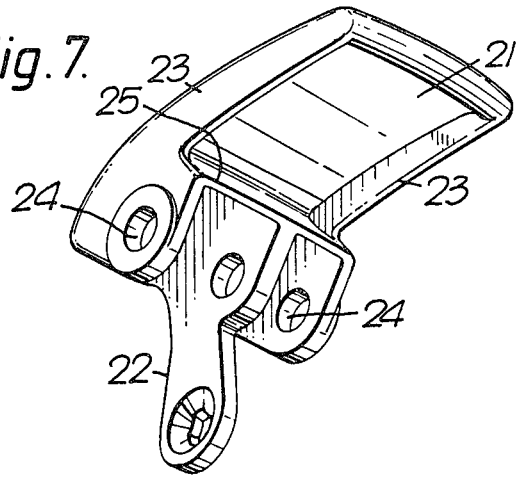
FIG. 7 shows a second component of the assembly of FIG. 1 and 2.
Figure 8:
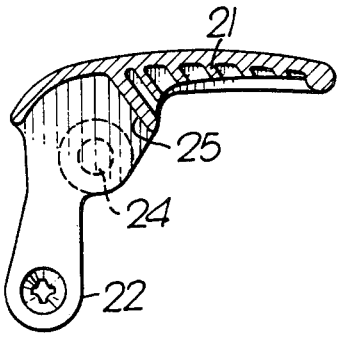
FIG. 8 is a sectional side view of an alternative component to that of FIG. 7.
Figure 9:
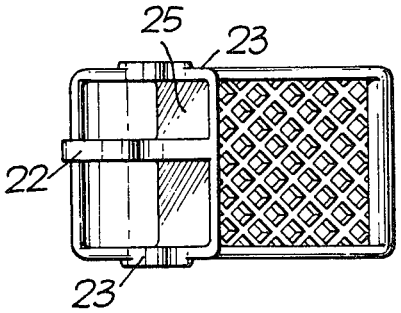
FIG. 9 shows an underneath view of the component of FIG. 8.
Figure 10:
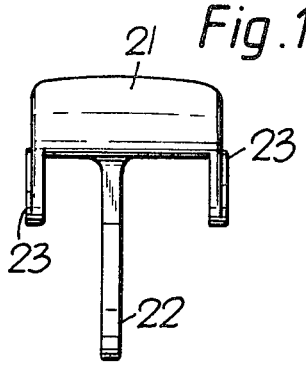
FIG. 10 shows an end view of the component of FIGS. 8 and 9.
Figure 13:
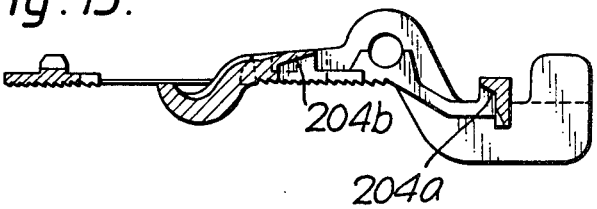
FIG. 13 is a view similar to FIG. 5.
Figure 14:
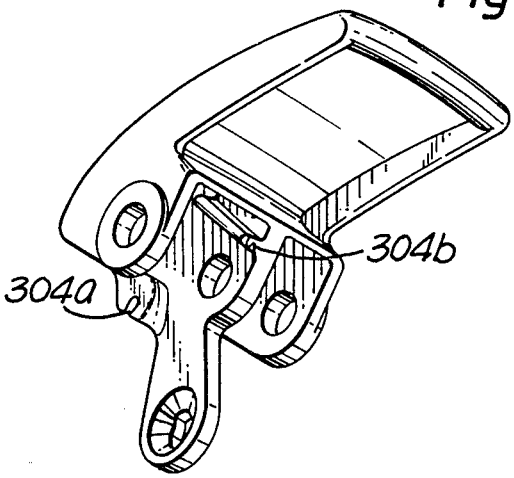
FIG. 14 is a view similar to FIG. 7.

The operating lever, seen in its basic form in FIG. 7 and in a modified form in FIGS. 8 to 10, comprises a curved elongate finger plate 21 and a crank arm 22, the crank arm extending from one end of the finger plate substantially perpendicularly thereto. The crank arm 22 may be positioned slightly eccentrically in relation to the finger plate 21 as shown, or may be centrally placed. At the edges of the finger plate depending flanges 23 are provided to stiffen the plate against bending. The flanges 23 are enlarged at the end adjacent the crank arm, and the flanges and crank arm are formed with aligned holes 24 to receive the spindle 3 when the handle is assembled. A web 25 extends across the underside of the finger plate. The undersurface of the finger plate 21 may be left plain, as seen in FIG. 7, or may be formed with a patterned surface as shown in FIGS. 8 and 9. In these figures the finger plate has a pattern of ribs on its underside to reinforce and provide an attractive finish to the finger plate.

The other components of the assembly are the spindle 3, which is preferably a tubular plastics component but can be of any suitable material, and a two-armed torsion spring 4.

Figure 2:
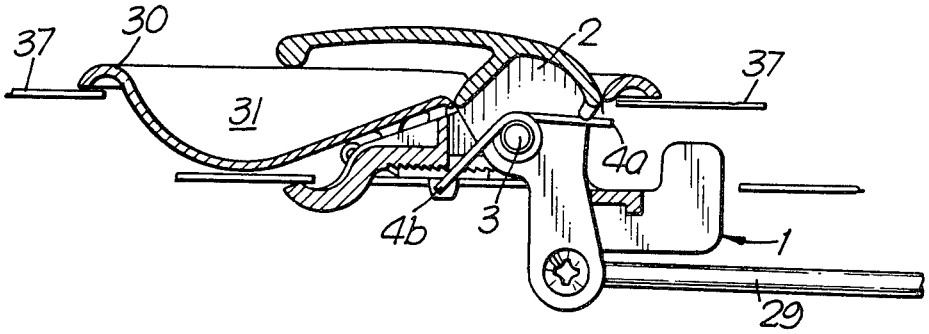
FIG. 2 shows a longitudinal central section of the assembly of FIG. 1 mounted in a door panel.

The handle is assembled by first positioning the operating lever above the main part 5 of the mounting 1, and bringing the lever down so that the lugs 10 of the main part 5 are received between the flanges 23, and the crank arm projects through the opening 15. The apertures 9 and 24, in the operating lever and mounting respectively, are brought into alignment and the spindle 3 is passed axially through the apertures to attach the operating lever pivotally to the mounting as shown in FIG. 2.

Prior to this assembly, the torsion spring 4 is positioned between the crank arm and one of the flanges of the finger plate so that during assembly the spindle 3 passes through the spring along its axis. The spring is thus held between the mounting and the operating lever, one arm 4*a* of the spring being positioned to abut the end of the finger plate adjacent to the crank arm of the operating lever, and the other arm 4*b* of the spring being positioned to abut a reacting surface on the mounting. In the embodiment shown, the arm 4*b* of the spring abuts one end of the opening 15 formed in the main part 5 of the mounting. In this configuration and torsion spring acts to urge the operating lever to rotate in an anticlockwise direction as shown in FIG. 2.

Once the handle assembly has been completed, mounting to a door panel is effected in a particularly rapid and efficient manner by the provision of the mounting comprising the main part 5 and the foot 6.

Figure 6:
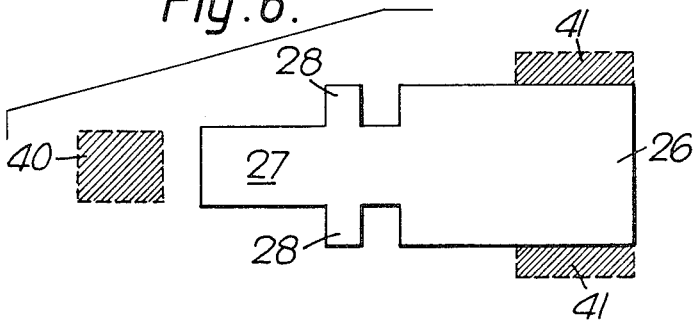
FIG. 6 shows the shape of mounting aperture required in the door panel, and the areas contacted on the underside of the panel by the mounting.

The handle is mounted to a door panel by first providing in the door panel an aperture of the shape shown in FIG. 6. The aperture consists of a large rectangular opening 26, from one of the shorter sides of which extends a slot 27. At a location intermediate the length of the slot 27, there are formed opposing cutouts 28 in the sides of the slot.

To assemble the mounting to the panel, the foot 6 is first folded to a position beneath the main part of the mounting 1, by bending the flexible straps 7. The flexible straps may be weakened at and/or near their midpoints, to assist in aligning the foot with the main part. This presents the foot in a position where the ratchet teeth 19 of the foot face the ratchet teeth 20 of the main part, and the lugs 17 of the foot project away from the main part of the mounting.

In this position, the foot is offered up to the panel in such a way as to insert the lugs 17 into the two cutouts 28. The abutment surfaces 18 provide snap-engagement between the foot and the panel.

With the foot thus secured, the main part of the mounting is then oriented so that the hook 8 engages the panel by passing through the slot 27 and abutting the undersurface (as seen in FIG. 2) of the panel adjacent the end of the slot, in the area 40 cross-hatched in FIG. 6.

Finally, the main part is pivoted about the hook to bring the resilient arms 11 towards and into the enlarged opening 26. The ramp surfaces 13 contact the longer edges of the opening 26 and cause the arms 11 to flex inwardly. When the ramp surfaces have passed through the opening 26, the arms 11 spring apart so that abutment surfaces 12 may engage the underside of the panel adjacent the opening in the area 41 cross-hatched in FIG. 6. During this final operation, the ratchet teeth 20 on the main part of the mounting approach, and then engage, the ratchet teeth 19 of the foot. Just before the ratchet teeth engage, the main part may be moved in a direction so as to reduce free play in the linkage described below.

A linking rod 29 connects the free end of the crank arm to the door opening mechanism. The linking rod is in this case connected in such a way that the door is opened by pulling the rod, so that by lifting the finger plate away from the door the crank arm pulls the linking rod to open it. The spring 4 then serves to return the finger plate and linking rod to the rest position.

The two sets of ratchet teeth are complementary, and co-operate to prevent motion of the baseplate to the right, referring to FIG. 2, while allowing limited motion to the left. The advantage of this capability is that, after the handle assembly is mounted to the door and the linking rod 29 is connected to the free end of the crank arm 22, any play in the linkage between the handle and door lock can be eliminated by moving the baseplate, and thus the operating lever 2, towards the left. When the play is eliminated, and the finger plate is in its correct rest position relative to the door, retrograde movement is prevented by the co-operating series of ratchet teeth.

Thus, the handle assembly is rapidly mounted and the linkage adjusted by simple operations involving no complex tools or procedure.

If it is required to demount the handle from the door, for example to readjust or replace the lock mechanism, then this is simply done by pinching together the finger grips 14 at the ends of the resilient arms 11. This allows the arms 11 to be withdrawn from the aperture and the main part of the mounting is pivoted away from the foot. To demount the foot from the panel, the foot is pinched in such a way as to urge the slot 16 to close, thus sliding the abutment surface 18 out of engagement with the panel. The foot may then be withdrawn from the panel.

In a preferred door handle assembly incorporating the mounting of the present invention, shown in FIGS. 11 to 14, the handle assembly is intended to co-operate with a door closing and locking mechanism operating in such a way that by pulling a linkage rod the closed door is opened and by pushing the linkage rod the closed door is locked. This type of mechanism does away with the separate sill button or other locking lever commonly used on automobile doors.

The handle assembly is similar to that described above in its construction and method of mounting, so to prevent undue repetition only the differences will be described.

The preferred handle assembly includes a mounting 101 as before, but the main part 105 of the mounting 101 is provided with two abutment surfaces 204*a*, 204*b* each of which engages an end of one of the arms 104*a*, 104*b*, of the spring 104.

Likewise, the operating lever is formed with two abutment surfaces 304*a*, 304*b* which engage the arms 104*a* and 104*b* of the spring 104.

Preferably, the abutment surfaces 204*a*, 204*b*, 304*a*, 304*b*, all abut the spring arms 104*a*, 104*b* when the spring is slightly stressed, so that no play exists in the assembled sides of the opening when the handle is mounted to a door. The opening may have to be widened so that the second cutout or cutouts is exposed. To effect the adjustment, the finger plate is lifted, as if to open the door, and a gap then appears between the bezel and the underside of the finger plate. Through this gap a screwdriver 36 or similar tool is introduced, one side of the blade engaging the or one of the first cutouts and the other side of the blade engaging the or one of the second cutouts. Rotation of the screwdriver will then urge the foot and the main part of the mounting to move in opposite directions, the directions depending on the sense of the rotation applied.

In this way, the handle may be adjusted without disturbing the finished door trim panels etc.

Figure 15:
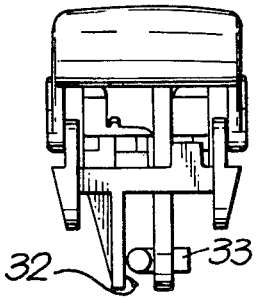
FIG. 15 shows the handle assembly of FIGS. 11 to 14 in end view, modified by including a guide surface for a linkage rod.
Figure 16:
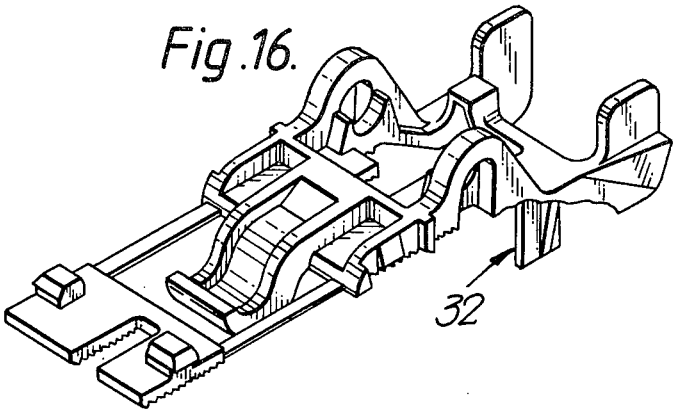
FIG. 16 is a perspective view in partial section of an alternative embodiment of the component of FIG. 3, the component including a guide surface for a linkage rod and is utilized in the assembly of FIG. 15.

In an alternative handle assembly utilising the mounting of the invention, illustrated in FIGS. 15 and 16, a guide surface 32 extends below the mounting to engage the linkage rod, and to restrain the rod from movement in a direction parallel to the spindle axis away from the crank arm 22. FIG. 16 is cutaway to show the guide surface more clearly. The provision of such a guide surface means that the connection between the operating rod and the crank arm can be simplified, for example the operating rod may have its extremity 33 bent over at 90° to the main part of the rod, the extremity being received in a simple transverse bore in the crank arm. The rod is then retained by the guide surface from disengagement with the crank arm. More than one guide surface may be provided, if required.

Advantageously the operating lever and the mounting are distinct integral plastics mouldings, and can therefore be of any suitable colour and any suitable surface finish.

As a further alternative, the mounting may comprise a main part and a separately moulded mounting foot.

Although the mounting is described herein specifically in relation to door handles, it will be understood that the mounting of the present invention will be applicable in a large number of situations where a component is to be handle. By this arrangement, the operating lever, and thus the finger plate, is held in its correct rest position in relation to the main part of the mounting.

Figure 11:
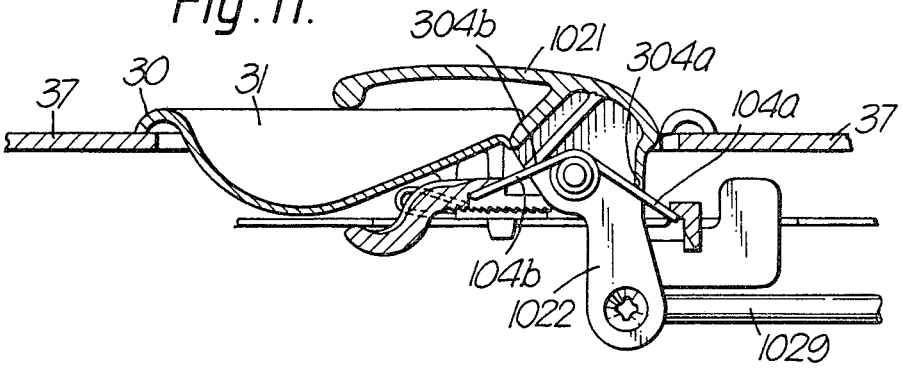
FIG. 11 is a view similar to FIG. 2 of a second door handle assembly.
Figure 12:
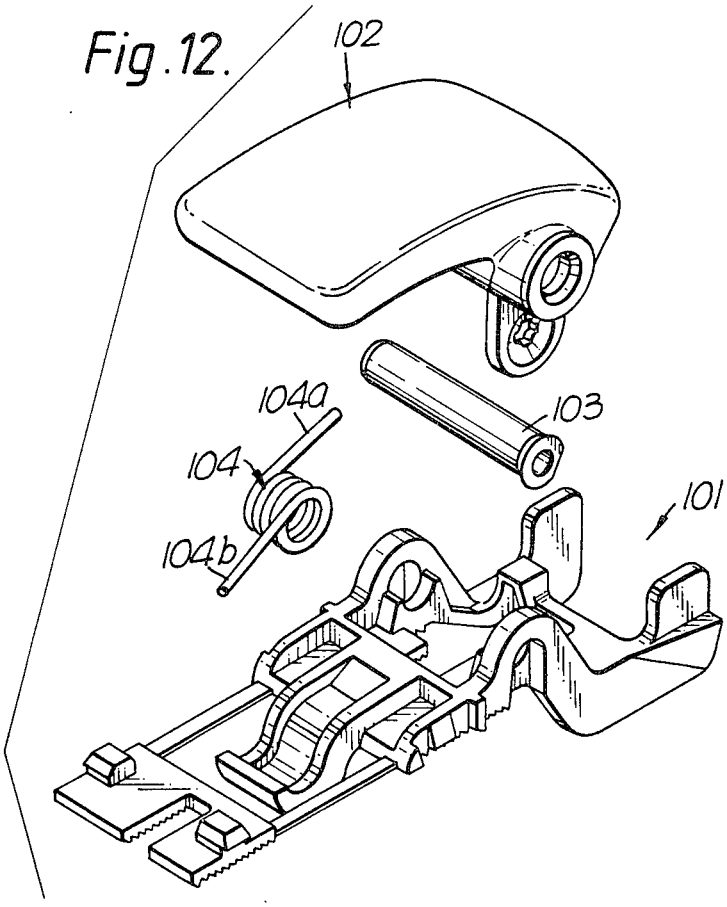
FIG. 12 is a view similar to FIG. 1 of the second door handle assembly.

As is clear from the view of FIG. 11, pivoting of the operating lever either clockwise or anticlockwise will result in the spring applying a restoring force, either by pressure on abutment surfaces 304*a* and 204*b* or on surfaces 304*b* and 204*a*, respectively.

As described in relation to the previous embodiment, a linking rod 1029 is attached to the free end of the crank arm 1022 of the operating lever 102. By pulling the finger plate 1021 away from the door the linking rod is pulled to open the door and by pushing the finger plate towards the door the linking rod is pushed to cause the lock to secure the door. As the finger plate, and thus the operating lever and linking rod, are returned to the rest position after locking the door, a lost-motion arrangement will have to be included in the operating linkage to prevent the door from being unlocked by the finger plate's return to the rest position.

In order to ensure a neat appearance, a trim panel 37 is fitted on the interior surface of the car door. The door handle is preferably received in a bezel 30 mounted flush with the trim panel 37, which bezel provides a finger recess 31 for access to the underside of the finger plate.

Figure 17:
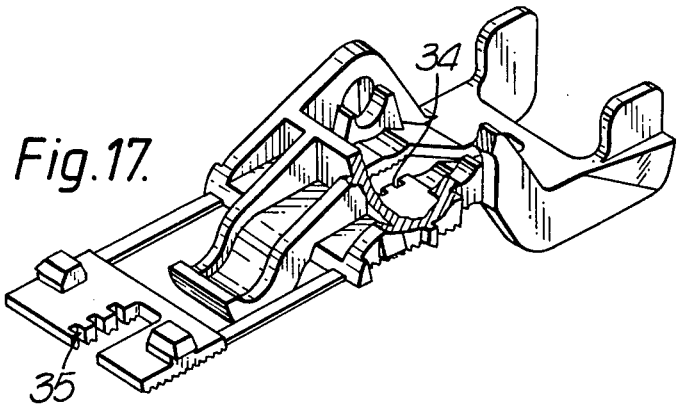
FIG. 17 is a cutaway perspective view of an alternative mounting, showing cutouts in the main part and foot to facilitate post-assembly adjustment.
Figure 18:
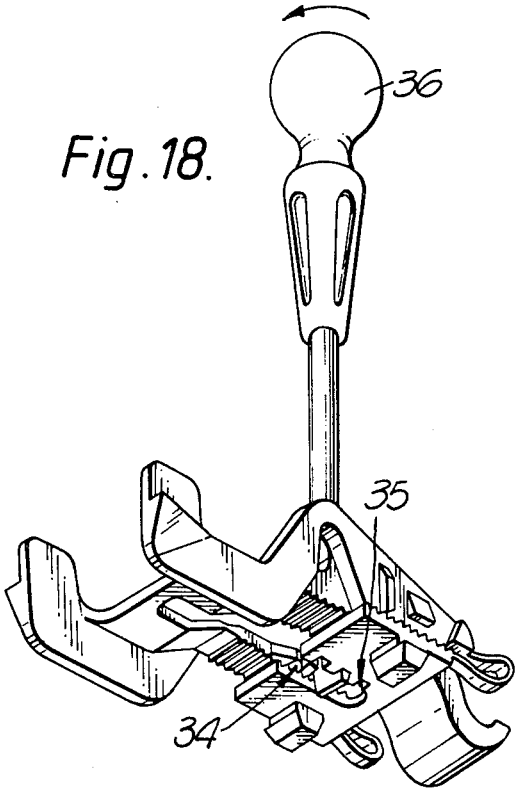
FIG. 18 is an underneath perspective view of the mounting of FIG. 17, showing a tool positioned to engage the cutouts to adjust the mounting.

In order to provide for adjustment of the mounting in both directions after assembly to a panel, the alternative embodiment seen in FIGS. 17 and 18 is proposed. In this alternative embodiment the teeth of the main part and the foot may be made symmetrical to resist equally relative motion between the mounting foot and the main part of the baseplate in either longitudinal direction.

To facilitate adjustments to the assembly, a first cutout or series of cutouts 34 is formed in one side of the opening in the main part of the baseplate, and a second cutout or series of cutouts 35 is formed in the side of the slot in the mounting foot, the first and second cutouts or series of cutouts being arranged to be on opposite attached to a panel and fine adjustment of the relative positions of the component and the panel is required.

I claim:

1. An adjustable mounting for assembly to a panel, comprising a main part and a foot, the foot being a substantially planar component and having on one face means to snap-engage in an aperture in the panel in order to secure the foot on one side of the panel, and on its other face a series of teeth, and the main part including abutment surfaces to engage the side of the panel remote from the foot, the abutment surfaces being so positioned and configured as to allow sliding motion of the main part in one direction relative to the panel, and the main part further including a series of teeth complementary to those of the foot and situated between the abutment surfaces so that when the abutment surfaces engage the panel the teeth of the main part engage those of the foot to resist relative motion between the main part and the foot in one direction.

2. An adjustable mounting according to claim 1, in which the main part of the mounting is elongate and has a hook projecting from one end and a pair of resilient arms carrying the abutment surfaces which engage, in use, the side of the panel remote from the foot, to allow sliding motion relative to the panel in the longitudinal direction of the main part of the mounting.

3. An adjustment mounting according to claim 1, in which the foot is formed with a slot and the main part is formed with an elongate opening, the slot and the opening extending in the direction of relative movement of the main part and panel, and being positioned to be at least partially coincident when the mounting is assembled to a panel.

4. An adjustable mounting according to claim 3 in which one side of the slot and the opposite side of the opening are each formed with one or more cutouts.

5. An adjustable mounting according to claim 1, in which the teeth of the main part and the foot are of ratchet form.

6. An adjustable mounting according to claim 4 in which the teeth are of symmetrical form.

7. An adjustable mounting according to claim 1 in which the foot and the main part are joined by a number of flexible straps.

8. An adjustable mounting according to claim 7 in which the strap or straps are weakened at or near their midpoint.

9. A door handle assembly for a motor vehicle including an adjustable mounting according to claim 4, which handle assembly includes an operating lever pivotally attached to the main part of the mounting, the operating lever including a finger plate and a crank arm, the crank arm extending through the opening in the main part of the mounting and through the slot in the foot of the mounting.

10. A door handle assembly according to claim 9, in which the operating lever is movable between a rest position and an operating position, spring biasing means being provided to urge the operating lever to return to the rest position when it is moved therefrom.

11. A door handle assembly according to claim 10 in which the operating lever has two operating positions, the rest position lying between the two operating positions.

* * * * *